US008931380B2

(12) United States Patent
Coffin

(10) Patent No.: US 8,931,380 B2
(45) Date of Patent: Jan. 13, 2015

(54) SKIN ENGAGING MEMBER FOR A RAZOR CARTRIDGE

(75) Inventor: David Coffin, Hamden, CT (US)

(73) Assignee: Eveready Battery Company Inc., St. Louis, MO (US)

( * ) Notice: Subject to any disclaimer, the term of this patent is extended or adjusted under 35 U.S.C. 154(b) by 178 days.

(21) Appl. No.: 13/718,077

(22) PCT Filed: Jul. 13, 2011

(86) PCT No.: PCT/US2011/043783

§ 371 (c)(1),
(2), (4) Date: Dec. 18, 2012

(87) PCT Pub. No.: WO2012/009393

PCT Pub. Date: Jan. 19, 2012

(65) Prior Publication Data

US 2013/0111760 A1 May 9, 2013

Related U.S. Application Data

(60) Provisional application No. 61/364,092, filed on Jul. 14, 2010.

(51) Int. Cl.
*B26B 21/40* (2006.01)

(52) U.S. Cl.
USPC ..... 83/13; 30/41.7; 30/34.2

(58) Field of Classification Search
USPC ..... 30/34.2, 41.7, 526, 538; 83/13
See application file for complete search history.

(56) References Cited

U.S. PATENT DOCUMENTS 4,170,821 A * 10/1979 Booth ..... 30/41
4,356,115 A * 10/1982 Shibanai et al. ..... 512/4
5,111,580 A * 5/1992 Bosscha et al. ..... 30/41.7
5,113,585 A 5/1992 Rogers et al.
5,388,331 A * 2/1995 Doroodian-Shoja Siamak ..... 30/41.7
6,182,365 B1 2/2001 Tseng et al.
6,295,733 B1 * 10/2001 Wexler et al. ..... 30/41
6,298,558 B1 10/2001 Tseng et al.

(Continued)

FOREIGN PATENT DOCUMENTS

WO 2010056780 A1 5/2010
WO 2010056781 A1 5/2010

OTHER PUBLICATIONS

Search report for application PCTUS/2011/043783 published as WO2012/009393A3.

*Primary Examiner* — Sean Michalski
(74) *Attorney, Agent, or Firm* — Energizer Personal Care, LLC

(57) ABSTRACT

A skin engaging member for a razor cartridge includes an erodible first layer and an erodible second layer below the first layer. Each layer includes a lubricious water soluble polymer and can include a water insoluble polymer. The second layer includes a fragrance that can be in the form of microcapsules or a suitable additive of the polymeric material(s). As the first layer erodes during normal use of the razor cartridge the second layer is eventually exposed dissolving or fracturing the microcapsules or otherwise releasing the fragrance. The fragrance is malodorous indicating to e.g. a vision impaired user that the optimal life of the razor cartridge is at or nearing its end. The first layer can also be provided with a non-malodorous fragrance. A third erodible layer can be provided between the first and second layer and can also include a fragrance. End-of-optimal-life indication can be rapid or gradual.

18 Claims, 4 Drawing Sheets

(56) References Cited

U.S. PATENT DOCUMENTS

| | | | | |
|---|---|---|---|---|
| 6,298,559 | B1 | 10/2001 | Kwiecien et al. | |
| 6,442,839 | B1 * | 9/2002 | Tseng et al. | 30/41 |
| 6,681,665 | B2 * | 1/2004 | Calwell | 83/13 |
| 6,854,368 | B2 * | 2/2005 | Calwell | 83/13 |
| 6,944,952 | B1 | 9/2005 | Tseng | |
| 7,100,283 | B1 * | 9/2006 | Grdodian et al. | 30/41.7 |
| 7,581,318 | B2 | 9/2009 | Coffin | |
| 8,347,088 | B2 * | 1/2013 | Moore et al. | 713/166 |
| 8,585,588 | B2 * | 11/2013 | Kovarik et al. | 600/300 |
| 2002/0000041 | A1 | 1/2002 | Doroodian-Shoja | |
| 2002/0085991 | A1 * | 7/2002 | Ainsley | 424/84 |
| 2004/0107808 | A1 * | 6/2004 | Calwell | 83/13 |
| 2005/0066526 | A1 | 3/2005 | Guimont | |
| 2007/0229818 | A1 * | 10/2007 | Duan et al. | 356/316 |
| 2008/0004660 | A1 * | 1/2008 | Assaf et al. | 607/2 |
| 2008/0180257 | A1 * | 7/2008 | Omi et al. | 340/575 |
| 2008/0216321 | A1 * | 9/2008 | Guimont et al. | 30/41 |
| 2009/0151216 | A1 * | 6/2009 | Haggerty | 43/1 |
| 2009/0157406 | A1 * | 6/2009 | Iwaki et al. | 704/258 |
| 2009/0178692 | A1 * | 7/2009 | Warr et al. | 134/6 |
| 2009/0188112 | A1 * | 7/2009 | Prochaska et al. | 30/34.05 |
| 2011/0197459 | A1 * | 8/2011 | Starling | 30/538 |
| 2012/0290132 | A1 * | 11/2012 | Kokubo et al. | 700/255 |
| 2012/0304412 | A1 * | 12/2012 | Lynch et al. | 15/246.2 |
| 2014/0150709 | A1 * | 6/2014 | Jones et al. | 116/201 |

* cited by examiner

SKIN ENGAGING MEMBER FOR A RAZOR CARTRIDGE

CROSS REFERENCE TO RELATED APPLICATIONS

This application claims the benefit of International Application PCT/US2011/043783, filed Jul. 13, 2011 which claims the benefit of U.S. provisional patent application Ser. No. 61/364,092, filed Jul. 14, 2010, the content of both being incorporated herein in their entirety for reference.

TECHNICAL FIELD

The present disclosure relates to a skin engaging member, also known as a shaving aid strip for a razor cartridge.

BACKGROUND

In shaving systems of the wet shave type, factors such as the frictional drag of the razor across the skin, the force needed to sever hairs, and irritation of pre-existing skin damage can create a degree of shaving discomfort. Discomfort, and other problems accompanying wet shaving systems, can be alleviated by the application of shaving aids to the skin Shaving aids can be applied prior to, during, or after shaving. A number of problems accompany the use of pre- and post-applied shaving aids. Pre-applied shaving aids can evaporate or can be carried away from the site of application by repeated strokes of the razor. Post-applied shaving aids are not present on the skin during shaving and thus their application can be too late to prevent an unwanted affect. Use of both pre-applied and post-applied shaving aids add additional steps to the shaving process.

Proposals have been made to incorporate a shaving aid e.g., lubricant, whisker softener, razor cleanser, medicinal agent, cosmetic agent or combination thereof, into a razor, e.g., by depositing a shaving aid in a recess on the razor, by incorporating a shaving aid directly into one or more molded polymeric components of the razor, by adhesively securing a shaving aid composite to the razor, and by use of a mechanical connection between a shaving aid composite and the razor. A water soluble shaving aid, e.g., polyethylene oxide, has been dispersed in a matrix of a water insoluble material, e.g., a polystyrene polymer, to form a skin engaging member also known as a shaving aid strip, a shaving aid composite, or a lubricating strip. The skin engaging member has been mounted in or on razor and shaving cartridge structures, adjacent the shaving edge or edges, of single or multiple blade shaving systems as disclosed in U.S. Pat. Nos. 4,170,821 to Booth and 5,113,585 to Rogers. Upon exposure to water, the water-soluble shaving aid leaches from the matrix of the skin engaging member onto the skin.

One problem associated with razor cartridges having a water soluble shaving aid is that a user has no indication when the razor cartridge is nearing the end of its optimal shave performance and should be replaced. One solution to this problem has been to utilize the skin engaging member or lubricating strip to provide an indication or signal to the user that the cartridge has reached the end of its optimal shave performance and should be replaced. Such solutions include the use of a two colored lubrication strip. As the user shaves the lubrication member wears away. Typically, in two color systems one of the layers, e.g., the first layer which can be colored blue, is positioned to wear away first thus exposing the second layer which has a different color than the first layer, e.g., white. This provides an indication to the user that the razor cartridge should be replaced.

One problem associated with the multi-color lube strip indicators is that they are generally ineffective for e.g. a vision-impaired user.

SUMMARY

The present disclosure has for its objective to eliminate, or at least substantially alleviate the limitations of the prior art by providing a skin engaging member in the form of a narrow elongated strip of dimensions suitable for placement in or on a razor cartridge. The skin engaging member comprises a first layer comprising an erodible skin engaging layer comprising a lubricious water soluble polymer. The skin engaging member comprises a second layer positioned below the first layer comprising an erodible skin engaging layer comprising a water soluble polymer and a first fragrance. The first fragrance is preferably malodorous. As the first layer erodes during normal use of the razor cartridge having the skin engaging member, the second layer is gradually exposed releasing the first fragrance. As the first fragrance is preferably malodorous, i.e. unpleasant, a user who can be vision-impaired will be alerted that the optimal shave performance of his or her razor cartridge is at or nearing its end and the razor cartridge should be replaced. The first layer can also include a second fragrance that is preferably different from the first fragrance and is preferably non-malodorous, e.g. a pleasing odor. This pleasing odor will accompany use of the razor cartridge during normal use during its optimal life.

A third layer can be provided positioned between the first layer and the second layer. The third layer comprises an erodible skin engaging layer comprising a water soluble polymer and a third fragrance. The third fragrance is preferably different to the first and second fragrance and can more preferably be less malodorous than the first fragrance. In this manner the third fragrance can provide an interim warning that the optimal shave performance of the user's razor cartridge is at or nearing its end.

The change of odor from pleasing to unpleasant can be relatively rapid, e.g. in the two-layer skin engaging member, or can be gradual e.g. in the three layer skin engaging member where an interim odor can be provided.

The present disclosure also includes a method of shaving. A razor cartridge is provided including a skin engaging member in the form of a narrow elongated strip of dimensions suitable for placement on the razor cartridge. The skin engaging member comprises a first layer and a second layer as previously described. The razor cartridge is used for a normal shaving operation by repeatedly contacting a wetted skin surface of a user with the razor cartridge and moving the razor cartridge along the skin surface to sever hair on the skin surface. After a number of uses of the razor cartridge the first layer will at least partially erode to expose the second layer and release the first fragrance of the second layer to indicate to the user that the razor cartridge should be replaced.

These and other features and advantages of the present disclosure will be more fully understood with reference to the following detailed description when taken in conjunction with the accompanying drawings.

DETAILED DESCRIPTION

Figure 1:
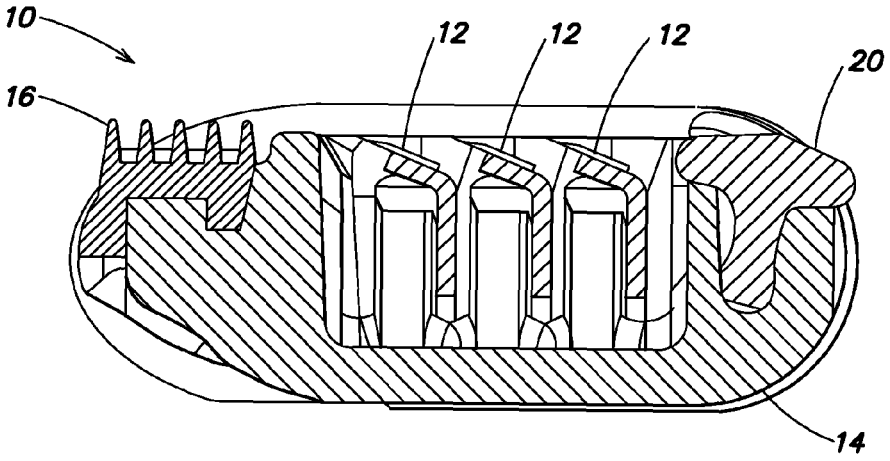
FIG. 1 is a sectional view of a razor cartridge which includes a skin engaging member of the present disclosure.
Figure 2:
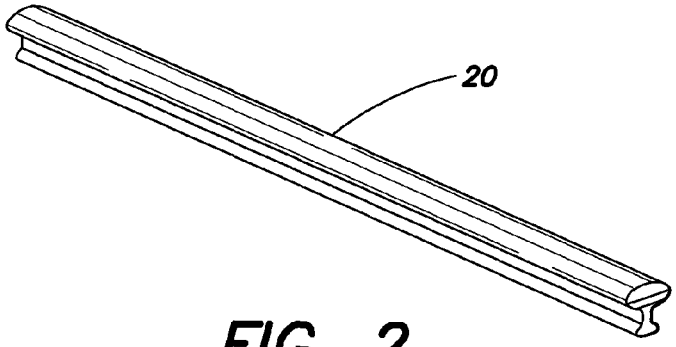
FIG. 2 is a perspective view of a skin engaging member of the present disclosure.

Referring to the drawings and in particular FIGS. 1 and 2 a razor cartridge 10 includes one or more razor blades 12. Three blades 12 are depicted in FIG. 1 but the present disclosure is not limited in this regard and any number of razor blades can be provided. The razor blades 12 are carried by a housing 14 which can also include a finned elastomeric guard 16. The razor cartridge also includes a skin engaging member also known as a shaving aid strip 20.

The skin engaging member 20 is in the form of a narrow elongated strip of dimensions suitable for placement on a razor cartridge. The skin engaging member 22 can be about 25 mm to about 37 mm in length. The skin engaging member 20 can be locked e.g. snap-fitted in an opening in the rear of the cartridge 10. The skin engaging member can also be secured to cartridge 10 by other methods such as ultrasonic welding or gluing. While shown at a rear portion of this particular razor cartridge, the skin engaging member can be located at any skin-engaging portion of the cartridge (e.g. a forward portion) and can be fabricated in any size or shape deemed appropriate.

Figure 3:
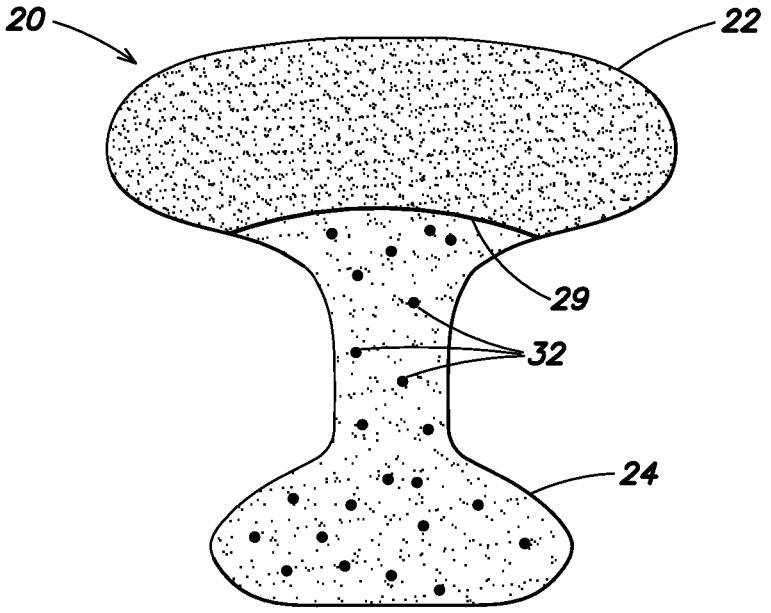
FIG. 3 is a sectional view of an embodiment of a skin engaging member of the present disclosure.
Figure 4:
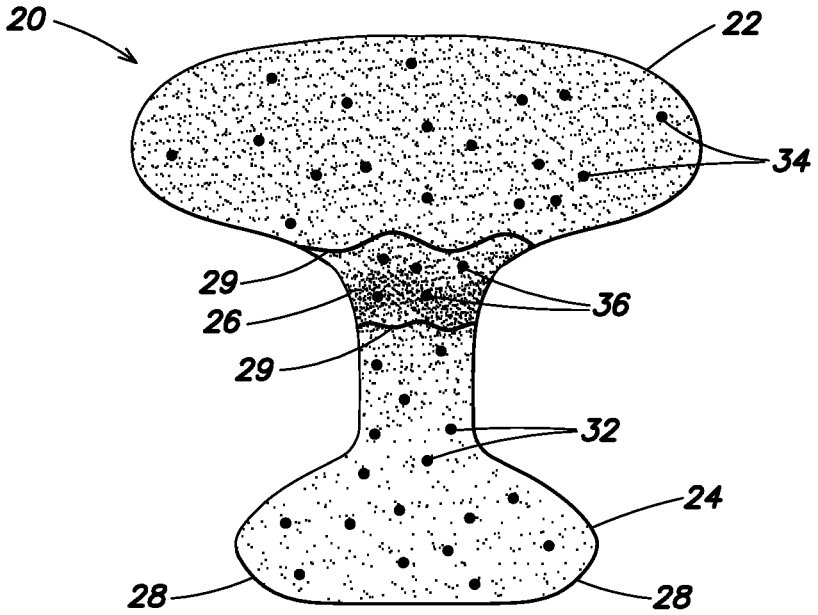
FIG. 4 is a sectional view of another embodiment of a skin engaging member of the present disclosure.

Referring now to FIGS. 3 and 4, skin engaging member 20 includes a first exposed lengthwise-extending erodible skin engaging layer or portion 22 and a second lengthwise-extending erodible skin engaging layer or portion 24 positioned below the first layer 22. A third lengthwise-extending erodible skin engaging layer or portion 26 can be positioned between the first layer 22 and the second layer 24. One or more of the layers can include a connecting portion 28 which serves to lock the skin engaging member into a mating receiving portion of the cartridge. As depicted the second layer 24 includes the connecting portion 28. The transition 29 between adjacent layers can be generally smooth (as shown in FIG. 3) or planar or can be irregular (as shown in FIG. 4). A benefit of an irregular transition is that the contact surface area between adjacent layers can be increased resulting in increased adhesion between the layers.

Each layer or portion of the skin engaging member or shaving aid strip 20 preferably comprises a solid polymeric material. Each layer of the skin engaging member 20 preferably comprises a lubricious water-soluble polymer as the main shaving aid and can also include a water-insoluble polymer to serve as a matrix in which the water-soluble polymer is dispersed. A layer having a greater amount of water-soluble polymer will wear at a faster rate or more quickly than a layer with a lower amount of water-soluble polymer, all other things being generally equal. Preferably, the first and/or third layer will comprise a greater amount of water-soluble polymer in percent by weight than the second layer. This structure allows the first and/or third layer to wear at a faster rate than the second layer during shaving. The second layer which can act to hold the skin engaging member in place within the cartridge and provides support for the first and second layers preferably comprises a lesser amount of water-soluble polymer by weight than the first and third layers.

Typical lubricious water-soluble polymers include polyethylene oxide, polyvinyl pyrrolidone, polyacrylamide, modified hydroxyalkyl cellulose, polyvinyl imidazoline, polyvinyl alcohol, polysulfone and polyhydroxyethylmethacrylate. The preferred lubricious water-soluble polymer is polyethylene oxide. The more preferred polyethylene oxides generally are known as POLYOX (available from Dow Chemical Company) or ALKOX (available from Meisei Chemical Works, Kyoto, Japan). These polyethylene oxides will preferably have molecular weights (MW) of about 100,000 to 8 million. It is preferred to use a blend of polyethylene oxides, typically a blend having at least one polyethylene oxide having a molecular weight in the range of 100,000 to 500,000 and at least one polyethylene oxide having a molecular weight in the range of 3 million to 8 million. The most preferred polyethylene oxide comprises a blend of about 40% to 80% by weight of polyethylene oxide having an average molecular weight of about 5 million (e.g. POLYOX COAGULANT) and about 60% to 20% of polyethylene oxide having an average molecular weight of about 300,000 (e.g. POLYOX WSR-N-750). A 60:40 blend of these two polyethylene oxides (5 million: 300,000) is especially preferred.

Suitable water-insoluble polymers which can be used include polyethylene, polypropylene, polystyrene, butadiene-styrene copolymer (e.g. medium and high impact polystyrene), polyacetal, acrylonitrile-butadiene-styrene copolymer, ethylene vinyl acetate copolymer, polyurethane and blends thereof such as polypropylene/polystyrene blend or polystyrene/impact polystyrene blend. The more preferred water-insoluble polymer is polystyrene, preferably a general purpose polystyrene, such as NOVA C2345A, or a high impact polystyrene (i.e. polystyrene-butadiene), such as NOVA 5410 or Total 975E. The strip or any portion should contain a sufficient quantity of water-insoluble polymer to provide adequate mechanical strength, both during production and use.

The shaving aid strip, or any portion, can also contain other shaving aid ingredients, such as low molecular weight water-soluble release enhancing agents such as polyethylene glycol (MW<10,000, e.g., 1-10% by weight PEG-100), water swellable release enhancing agents such as cross-linked polyacrylics (e.g., 2-7% by weight), antioxidants, preservatives, botanical oils, vitamin E, aloe, cooling agents, essential oils, beard softeners, astringents, medicinal agents, mineral oil, colorants etc.

The second layer 24 comprises a first fragrance which is malodorous. In the context of the present disclosure the term malodorous is intended to mean the odor is subjectively perceived as unpleasant by a typical user. As the perception of odor is individually highly subjective, the malodorific quality of the fragrance is preferably determined by computing (e.g. averaging) rankings from a number of test subjects each given fragrance samples to rank For example, odors can be ranked on a 1-5 scale where 1=highly pleasant, 2=pleasant, 3=neutral, i.e. neither pleasant nor unpleasant, 4=unpleasant, 5=highly unpleasant. Thus, according to this ranking the first fragrance should have an average ranking greater than 3. The first fragrance is preferably provided in microencapsulated form as microcapsules or microspheres 32 embedded in and e.g. randomly distributed in the second layer. The microcapsules can be of the type where the shell dissolves upon contact with water, thus releasing the contents of the microcapsule. The microcapsules can also be of the type where the shell fractures upon application of a mechanical force, e.g. abrasion by skin contact during normal use. During normal use of the razor cartridge having the skin engaging member of the present disclosure, the first layer will initially contact the skin After a number of shaving operations the first layer will partially or completely erode to expose the second layer. In turn erosion of the second layer will expose one or more fragrance microcapsules which will dissolve or fracture releasing their fragrance. This will alert the user, e.g. a vision impaired user, that the razor cartridge is at or nearing the end of its optimal life and should be replaced. The first layer can also include a second fragrance which can also preferably be provided in microcapsules 34. The second fragrance is preferably non-malodorous, i.e. in the context of the present disclosure neutral or pleasing to a typical user. As the first layer erodes during normal use of the razor cartridge the microcapsules of the second fragrance will dissolve or fracture releasing their non-malodorous fragrance. As described above, the change from either no fragrance or non-malodorous fragrance to malodorous can be relatively rapid to indicate the end of the optimal life of the razor cartridge.

A third layer 26 can be provided between the first layer and the second layer and can comprise a third fragrance which can also preferably be provided in microcapsules 36. The third fragrance can be less malodorous than the first fragrance (as determined by the multi-user ranking scale previously mentioned). In this embodiment the, the change from either no fragrance or non-malodorous fragrance to malodorous can be gradual or less rapid than previously mentioned as the third fragrance will be released before the first fragrance as the layers erode.

Figure 5:
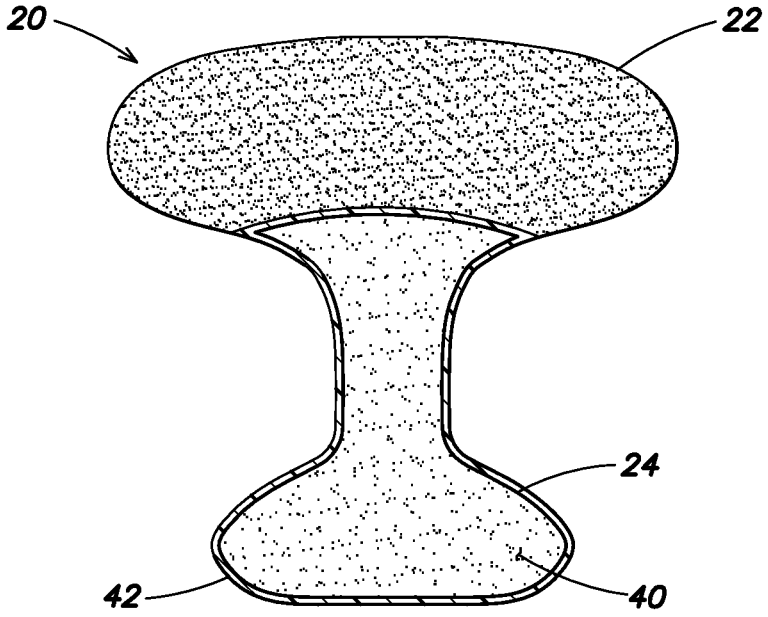
FIG. 5 is a sectional view of a further embodiment of a skin engaging member of the present disclosure.
Figure 6:
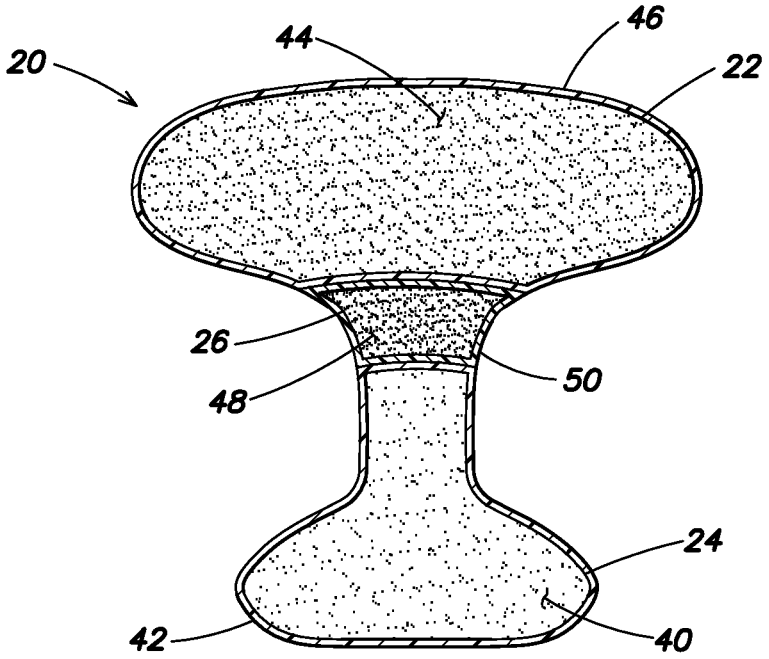
FIG. 6 is a sectional view of a yet further embodiment of a skin engaging member of the present disclosure.

Referring now to FIGS. 5 and 6, alternative embodiments of the skin engaging member are depicted. The second layer is formed in a core 40 and sheath 42 construction, e.g. by coextrusion. The core includes the first fragrance which can be provided as an additive in the polymeric materials, e.g. an inclusion complex or inclusion compound of the fragrance with a cyclodextrin or another suitable vehicle for the fragrance. The sheath provides a seal to prevent release of the first fragrance until the first layer is fully or partially eroded and a portion of the sheath of the second layer is also eroded exposing the fragrance containing core of the second layer. In embodiments having a fragrance in the first layer, this layer can also be formed in a core 44 and sheath 46 construction. A third layer can also be formed in a core 48 and sheath 50 construction if the third layer includes a fragrance.

The skin engaging member can be formed by combining multiple (e.g. two or three) extrudates via a multi-input transition die assembly to form a continuous coextruded body. The body can be cooled and cut to length suitable for use as a skin engaging member of a razor cartridge. The cut ends of the skin engaging member can be sealed to prevent release of any fragrance from the cut ends. Suitable sealing is disclosed in U.S. Pat. No. 7,581,318 to Coffin, the entire contents of which are incorporated herein for reference.

Figure 7:
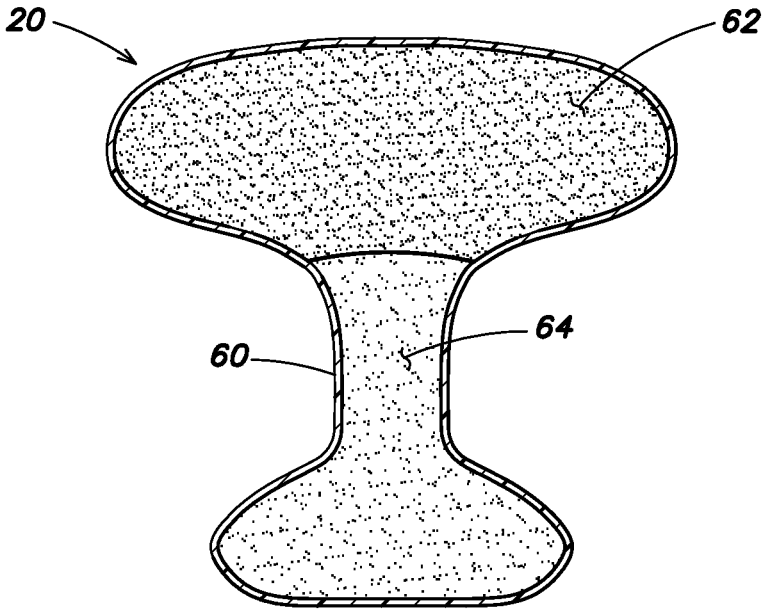
FIG. 7 is a sectional view of a yet further embodiment of a skin engaging member of the present disclosure.
Figure 8:
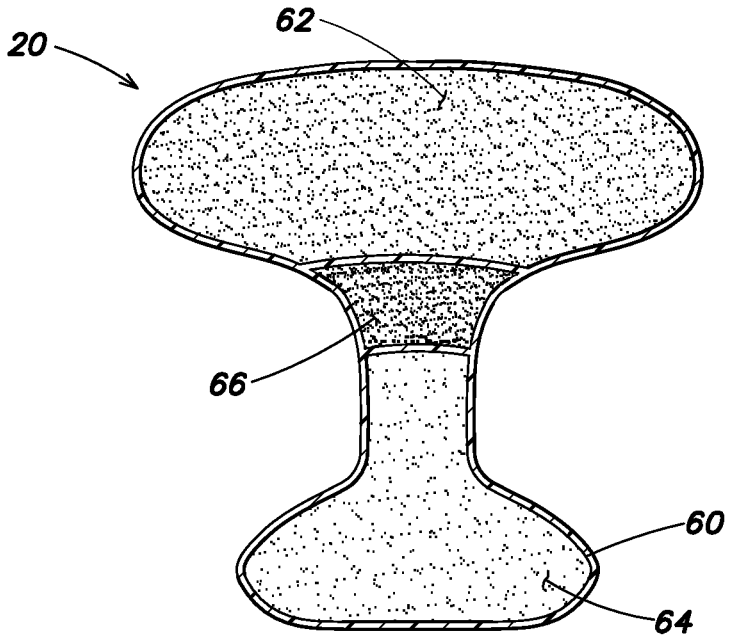
FIG. 8 is a sectional view of a yet further embodiment of a skin engaging member of the present disclosure.

Referring now to FIGS. 7 and 8, further alternative embodiments of the skin engaging member are depicted. In these embodiments two or more layers that can be e.g. extrudates are arranged adjacent and the two or more layers are then enclosed by a single sheath material. In FIG. 8 the layers 62, 64 and 66 are shown spaced apart and a single sheath material 60 envelopes each layer. In FIG. 7 the layers 62, 64 are in contact and single sheath material 60 envelopes all layers.

The skin engaging member can also be formed by a multi-shot (e.g. two-shot or three shot) injection molding process. The skin engaging member can also be formed by any suitable multi-layer forming process, e.g. powder compression that can be assisted by ultrasonic energy.

Although the disclosure has been described and illustrated with reference to specific illustrative embodiments thereof, it is not intended that the disclosure be limited to those illustrative embodiments. Those skilled in the art will recognize that variations and modifications can be made without departing from the true scope of the disclosure as defined by the claims that follow. For instance, features disclosed in connection with any one embodiment can be used alone or in combination with each feature of the respective other embodiments.

What is claimed is:

1. A skin engaging member in the form of a narrow elongated strip of dimensions suitable for placement on a razor cartridge, the skin engaging member comprising:

a first layer comprising an erodible skin engaging layer comprising a lubricious water soluble polymer; and a second layer positioned below the first layer comprising an erodible lubricious water soluble polymer and a first fragrance of a first odor;

wherein the first odor is malodorous.

2. The skin engaging member of claim 1, wherein the first layer further comprises a second fragrance of a second odor.

3. The skin engaging member of claim 2, wherein the first odor and the second odor are different.

4. The skin engaging member of claim 2, wherein the second odor is non-malodorous.

5. The skin engaging member of claim 1, wherein the skin engaging member further comprises a third layer between the first layer and the second layer, the third layer comprising an erodible lubricious water soluble polymer and a third fragrance of a third odor.

6. The skin engaging member of claim 5, wherein the third odor and the first odor are different.

7. The skin engaging member of claim 5, wherein the third odor is malodorous.

8. The skin engaging member of claim 7, wherein the third odor is less malodorous than the first odor.

9. The skin engaging member of claim 1, wherein the second layer comprises a second layer core and a second layer sheath and the second layer core includes the first fragrance.

10. The skin engaging member of claim 2, wherein the first layer comprises a first layer core and a first layer sheath and the first layer core includes the second fragrance.

11. The skin engaging member of claim 5, wherein the third layer comprises a third layer core and a third layer sheath and the third layer core includes the first fragrance.

12. The skin engaging member of claim 1, wherein the skin engaging member further comprises a single sheath that encloses the first layer and the second layer.

13. The skin engaging member of claim 5, wherein the skin engaging member further comprises a single sheath that encloses the first layer, the second layer and the third layer.

14. The skin engaging member of claim 2, wherein the skin engaging member further comprises a third layer between the first layer and the second layer, the third layer comprising an erodible lubricious water soluble polymer and a third fragrance of a third odor.

15. The skin engaging member of claim 14, wherein the third odor and the first odor are different.

16. The skin engaging member of claim 14, wherein the third odor is malodorous.

17. The skin engaging member of claim 16, wherein the third odor is less malodorous than the first odor.

18. The skin engaging member of claim 14, wherein the third layer comprises a third layer core and a third layer sheath and the third layer core includes the first fragrance.

* * * * *